US012655504B2

(12) United States Patent
Mohr et al.

(10) Patent No.: US 12,655,504 B2
(45) Date of Patent: Jun. 16, 2026

(54) STEEL HAVING AN AUSTENITIC STRUCTURE, AND USE OF SUCH A STEEL FOR APPLICATIONS IN THE ORAL CAVITY OF A HUMAN OR AN ANIMAL

(71) Applicant: Deutsche Edelstahlwerke Specialty Steel GmbH & Co. KG, Witten (DE)

(72) Inventors: Andreas Mohr, Essen (DE); Horst Hill, Grefrath (DE); Oliver Ripkens, Kerken (DE); Philipp Niederhofer, Bochum (DE); Janosch Conrads, Gladbeck (DE)

(73) Assignee: Deutsche Edelstahlwerke Specialty Steel GmbH & Co. KG, Witten (DE)

( * ) Notice: Subject to any disclaimer, the term of this patent is extended or adjusted under 35 U.S.C. 154(b) by 0 days.

(21) Appl. No.: 18/268,058

(22) PCT Filed: Dec. 14, 2021

(86) PCT No.: PCT/EP2021/085594
§ 371 (c)(1),
(2) Date: Jun. 16, 2023

(87) PCT Pub. No.: WO2022/128981
PCT Pub. Date: Jun. 23, 2022

(65) Prior Publication Data

US 2024/0043971 A1 Feb. 8, 2024

(30) Foreign Application Priority Data

Dec. 18, 2020 (EP) ..... 20215553

(51) Int. Cl.

| | |
|---|---|
| ***C22C 38/04*** | (2006.01) |
| ***C22C 38/00*** | (2006.01) |
| ***C22C 38/22*** | (2006.01) |
| ***C22C 38/38*** | (2006.01) |

(52) U.S. Cl.
CPC ..... *C22C 38/04* (2013.01); *C22C 38/001* (2013.01); *C22C 38/22* (2013.01); *C22C 38/38* (2013.01)

(58) Field of Classification Search
CPC ..... C22C 38/04
See application file for complete search history.

(56) References Cited

U.S. PATENT DOCUMENTS

| | | | | |
|---|---|---|---|---|
| 4,493,733 | A * | 1/1985 | Yamamoto | C22C 38/38 420/59 |
| 2011/0008714 | A1 | 1/2011 | Abd Elhamid et al. | |
| 2014/0338800 | A1* | 11/2014 | Leinonen | C21D 8/0247 148/567 |
| 2023/0063669 | A1* | 3/2023 | Mohr | B22F 10/64 |

FOREIGN PATENT DOCUMENTS

| | | | |
|---|---|---|---|
| CN | 104878316 | A | 9/2015 |
| CN | 105925814 | A | 9/2016 |
| JP | 2000239799 | A | 9/2000 |
| JP | 2016102244 | A | 6/2016 |
| JP | 2017031483 | A * | 2/2017 |

OTHER PUBLICATIONS

English machine translation of JP 2017-031483 A of Omura (Year: 2017).*

* cited by examiner

*Primary Examiner* — Jophy S. Koshy
(74) *Attorney, Agent, or Firm* — The Webb Law Firm

(57) ABSTRACT

Disclosed herein is a nickel-free and cobalt-free, rust-proof austenitic steel, which meets dental requirements for corrosion resistance, thermal expansion coefficient, mechanical properties and castability. In some embodiments, the steel consists of, in % by mass, C: >0.2-0.8%, N: 0.3-1.3%, Si: ≤2.0%, Mn: 14-30%, Cr: 17-27%, Mo: 0-6%, W: 0-6%, Nb: 0-6%, Ga: 0-6%, Ta 0-6%, the remainder being iron and unavoidable impurities. The content of impurities complies with the stipulations in DIN EN ISO 22674:2016-09 for dental materials. In some embodiments, the steel composed has an austenitic structure, an offset yield strength Rp0.2 of at least 230 MPa, a percent elongation A of more than 5%, and a modulus of elasticity of at least 150 GPa.

6 Claims, No Drawings

STEEL HAVING AN AUSTENITIC STRUCTURE, AND USE OF SUCH A STEEL FOR APPLICATIONS IN THE ORAL CAVITY OF A HUMAN OR AN ANIMAL

CROSS-REFERENCE TO RELATED APPLICATIONS

This application is the United States national phase of International Application No. PCT/EP2021/085594 filed Dec. 14, 2021, and claims priority to European Patent Application No. 20215553.7 filed Dec. 18, 2020, the disclosures of which are hereby incorporated by reference in their entireties.

BACKGROUND OF THE INVENTION

Field of the Invention

The invention relates to a steel having an austenitic structure.

The invention also relates to the use of a steel, in particular for dental applications.

Description of Related Art

The mechanical characteristics and corrosion properties given in the present text are determined in accordance with DIN EN ISO 22674:2016-09 (shown here from strength class 3 and above).

If, in the present text, "%" specifications are provided for alloys or steel compositions, these respectively refer to the mass (specification in "% by mass"), unless explicitly mentioned otherwise.

The metallic dental alloys commonly used today can be divided into two areas. One area includes noble metal alloys, which include materials based on gold, silver, palladium or platinum. The other area is reserved for more cost-effective non-noble metal alloys. These can, in turn, be distinguished from nickel-chromium (NiCr) and cobalt-chromium (CoCr) by their main alloy systems.

At present, approximately 1,400 different dental alloys are permitted in Germany. They are characterized by very good corrosion resistance in order to withstand corrosive attack by saliva, gastric acid and other media occurring in the oral cavity. In addition, material for dental applications must have a certain hardness and mechanical strength in order to be able to withstand the stresses occurring during chewing.

In addition, dental alloys must be non-magnetic and biocompatible to avoid rejection reactions, allergic reactions or other sensitization of the patient. These requirements prove to be a problem in particular in the case of NiCr-based materials. Nickel allergy is the most common allergic reaction to a metallic material. NiCr alloys can therefore only be used to a limited extent.

As an alternative to the NiCr base materials, CoCr alloys for medical dental prostheses are used in particular in Europe. However, these are significantly more expensive than nickel alloys. In addition, there is a suspicion that cobalt in the body may be a trigger or promoter of cancer. Should this suspicion be confirmed, it will no longer be possible to use cobalt alloys in the human body in the future.

A further example of a steel provided in particular for use in the human body is known from EP 0 918 099 A1. It is a chromium-manganese steel alloy that consists of, in % by mass, 0.08-0.25% C, ≤0.015% S, ≤0.050% P, 12 17% Mn, 0.2-1% Si, 1-3% Cu, 2-6% Co, ≤0.01% titanium, 3-6% Mo, 17-22% Cr, ≤1.0% Ni, ≤0.01% Al, ≤0.01% niobium, ≤0.01% B, ≤0.2% V, 0.5-0.9% N, and the remainder consisting of iron and unavoidable impurities, wherein the steel should have a nickel equivalent of above 17, preferably of above 20, and should have a PREN value of at least 37, in particular more than 45, calculated according to the formula PREN=% Cr+3.3×% Mo+20×% N from the Cr content % Cr, the Mo content % Mo and the N content % N, which indicates good corrosion resistance.

In addition to the reactions that nickel and cobalt alloys can cause in the human body, there are occupational safety issues to consider when working with these alloys. The processing of dental materials is usually done manually by machining, such as by grinding, milling and the like. As a result, there is a risk that the dust produced can enter the body through the lungs and damage it in this way.

In addition to the prior art explained above, CN 104 878 316 A describes a conventional austenitic steel that consists of, in % by mass, 0.1-0.15% C, 0.5-0.95% N, 0.5-1.5% Si, 13-19% Mn, 15-21% Cr, 0.5-2% Mo, 0.01-0.5% Nb, up to 3% Ni, 0.001-0.04% B, 0.01-0.05% Ti, 0.05-0.15% Al and the remainder being Fe and unavoidable impurities. In this case, B, Ti and Al are provided to reduce the Ni content of the steel without having to sacrifice of strength and ductility.

Furthermore, J P 2000 239799 A discloses a steel alloy that also aims to avoid Ni as an alloying element. In the case of N contents of 0.06-0.5% by weight, the C content is limited here to not more than 0.06% by weight.

CN 105 925 814 A describes a steel alloy suitable for dental applications and the like, which contains, in % by mass, up to 0.2% C, 0.7-2% N, ≤1% Si, 12-30% Mn, 15-30% Cr, up to 4.5% Mo, up to 4.5% Ni and the remainder being Fe and unavoidable impurities. The alloys specified in this publication for practical use each contain C-contents of at most 0.15% by mass.

JP 2016-102244 A relates to a prior art in which Ni is explicitly present as an effective mandatory component. Thus, at a C content of 0.05 to 0.15% by mass, this prior art provides for minimum contents of Ni of 0.1% by mass in combination with Cr contents of 15-20% by mass and Mn contents of 10-20% by mass and additional V contents of at least 0.005% by weight and Cu contents of at least 0.05% by weight.

Similarly, in U.S. 2011/0008714 A1, a steel for a fuel cell is alloyed with C contents of up to 0.075% by weight and Ni contents of 0.5-1.5% by weight in combination with Cr contents of 17-20% by weight and Mn contents of 4.0-35% by weight.

Against this background, there is a need for alloys for use in the oral cavity that are free of Ni and Co, but have properties similar to the known NiCr and CoCr alloys. Thus, dental alloys of the type discussed here should have

- an austenitic and therefore non-magnetic structure,
- high corrosion resistance characterized by a release of less than 200 μg/cm$^2$ within 7 days,
- an offset yield strength Rp0.2 of at least 270 MPa,
- a percent elongation A of more than 5%,
- a modulus of elasticity of more than 150 GPa (only defined from strength class 5 and above),
- good castability,
- good mechanical machinability and
- good suitability for ceramic veneering.

Suitability for ceramic veneering requires that no thermally induced stresses occur between the component consisting of the alloy in question and the ceramic layer with which the component is veneered, either during fabrication or during use. This can be ensured in that the thermal expansion coefficient of the alloy of the component can be adapted to the thermal expansion coefficient of the veneer ceramic. Alternatively or additionally, it is also possible to prevent flaking of the veneer in that the connection between the metal material of the component and the veneer ceramic reactive elements is improved. However, the elements suitable for this purpose generally have a high affinity for oxygen, such as manganese.

The background of the prior art explained above gave rise to the object of developing a nickel-free and cobalt-free austenitic stainless steel that reliably meets the requirements for corrosion resistance, its mechanical properties, its castability and its thermal expansion coefficient in dental technology.

SUMMARY OF THE INVENTION

The invention has achieved this object by means of a steel that has the composition specified herein and is suitable, on the basis of its spectrum of properties, in particular for the production of components for use in the oral cavity of humans or animals.

Advantageous embodiments of the invention are specified in the dependent claims and are explained in detail below, as is the general inventive concept.

DESCRIPTION OF THE INVENTION

A steel according to the invention accordingly has an austenitic, non-magnetic structure and has an offset yield strength Rp0.2 of at least 230 MPa, a percent elongation A of more than 5% and a modulus of elasticity of at least 150 GPa. For this purpose, the steel according to the invention consists of, in % by mass, C: >0.2-0.8%,
N: 0.3-1.3%,
Si: <2.0%,
Mn: 14-30%,
Cr: 17-27%,
Mo: 0-6%,
Nb: 0-6%,
W: 0-6%,
Ga: 0-6%,
Ta 0-6%, the remainder being iron and unavoidable impurities, wherein the content of impurities complies with the stipulations in DIN EN ISO 22674:2016-09 for dental materials.

The invention is based on the knowledge that higher contents of carbon ("C") and nitrogen ("N") can reliably be used to produce austenitic hardening stainless steel materials, as known, for example, from DE 10146616 A1. Such steel materials have a total of 0.4-0.7% by mass of C and N, in the case of up to 0.7% by mass of Si, 17-21% by mass of Mn and 16.5-18.5% by mass of Cr, the remainder being iron, a high proportion of the interstitially dissolved C and N atoms. These stabilize the austenitic structure and improve the mechanical properties of the alloy through increased solid solution hardening. For example, C+N-alloyed stainless austenitic steels have significantly higher strengths than the classic austenitic stainless steels, such as, for example, the steel standardized under material number 1.4404, which consists of, in % by mass, up to 0.03% C, up to 1.00% Si, up to 2.00% Mn, 16.5-18.5% Cr, 2.0-2.5% Mo and 10.0-13.0% Ni, the remainder being iron and unavoidable impurities.

In order to also utilize and expand favorable effects of the presence of C and N, the invention provides a C content of 0.05% by mass to 0.8% by mass, in particular to 0.7% by mass, and an N content of 0.3% by mass to 1.3% by mass, in particular to 1.0% by mass, so that the sum of the contents of C and N in the case of a steel according to the invention is 0.35% by mass to 2.1% by mass, in particular to 2.0% by mass, to 1.8% by mass or to 1.7% by mass. In practice, C contents of more than 0.2% by mass, in particular more than 0.20% by mass, such as at least 0.25% by mass, at least 0.3% by mass, in particular at least 0.30% by mass, or at least 0.34% by mass, have proven to be particularly suitable for the purposes according to the invention.

The high C and N contents provided according to the invention result in C and N providing a further increased proportion of the solid solution hardening of the steel according to the invention and thus to its high mechanical characteristics. In addition, the C+N steel according to the invention has a further increased corrosion resistance, in particular against pitting corrosion, due to its high proportion of interstitially dissolved N. At the same time, the expansions of the C and N contents provided according to the invention result in a larger melting interval and, as a result, the melting metallurgical processing is facilitated by a better casting behavior of a melt alloyed according to the invention. The minimum C and N contents required according to the invention ensure that these effects occur reliably. In contrast, the C and N content of a steel according to the invention is limited in total to a maximum of 2.1% by mass in order to avoid an increased carbide or nitride formation. This would reduce the corrosion characteristics. At the same time, higher C and N contents would increase strength and hardness. However, this would greatly complicate the processing and reworking of the material. In addition, toughness is greatly reduced when the C and N content is too high. With respect to an optimized effect of C and N, C and N contents of a total of not more than 2.0% by mass (with a C content of not more than 0.7% by mass and an N content of not more than 1.3% by mass), of a total of not more than 1.8% by mass (with a C content of not more than 0.8% by mass and an N content of not more than 1.0% by mass), or of a total of not more than 1.7% by mass (with a C content of not more than 0.7% by mass and an N content of not more than 1.0% by mass) have proven particularly successful.

To prevent other alloying elements, such as W, Mo and Cr, from forming primary carbides with an excessively high C-supply, the C content can be maintained at a low level compared to the N content. Such primary carbides of this kind can be seen as critical both in the case of the melting metallurgical production of semi-finished products consisting of steel according to the invention and in the subsequent processing in the dental laboratory because they are formed from the melt and can lead to reduced corrosion resistance and embrittlement. For this reason, it may be expedient to restrict the C content to values of not more than 0.7% by mass, in particular not more than 0.6% by mass, and to achieve the austenite stability primarily by means of the elements Mn and N. N contents of at least 0.4% by mass, in particular at least 0.5% by mass, have proven to be particularly successful for this purpose.

Silicon ("Si") can be provided in the steel according to the invention in contents of up to 2.0% by mass. At higher Si contents, too much ferrite would be stabilized in the structure of the steel, causing the material to lose its non-magnetic properties. Negative effects of the presence of Si can be avoided by limiting the Si content to not more than 1.5% by mass, in particular not more than 1.3% by mass.

As already mentioned, manganese ("Mn") in the steel according to the invention is present in contents from 14% by mass to 30% by mass, in particular from 16% by mass to 28% by mass, in order to facilitate the addition of the high N contents provided according to the invention by the solubility of the melt increased as a result of the presence of Mn. As a result, the production of the steels under atmospheric pressure is possible. In addition, Mn, like C and N, is a strong austenite stabilizer.

The combined presence of the contents of Mn, C and N specified according to the invention makes it possible to completely replace nickel ("Ni") as an austenite stabilizer. The positive influences of Mn on the properties of a steel alloyed according to the invention can be used particularly effectively given Mn contents of at least 16% by mass, in particular of at least 17% by mass. However, in the case of Mn contents above 30% by mass, there is a risk that, with respect to the non-magnetic properties, undesired ferrite is formed in the structure of the steel according to the invention. In addition, excessively high Mn contents would increase the thermal expansion coefficient. This effect should also be avoided in view of the practical utility of the material according to the invention. Mn contents of <23% by mass, in particular not more than 22.5% by mass, have proven to be particularly suitable in practice.

The high Mn content of a steel according to the invention, in combination with the likewise prescribed Cr contents, has the further effect that the steel according to the invention has a high affinity for oxygen. The ceramics used in the dental industry are almost exclusively oxide ceramics, as a result of which a high proportion of oxygen is present in the veneer ceramics. Thus, by varying of the manganese content in the context of the proviso according to the invention, the adhesion between the alloy and the veneer ceramic can be directly influenced. Mn contents of the steel according to the invention of not more than 28% by mass, in particular not more than 27% by mass or in particular <23% by mass, such as not more than 22.5% by mass, have proven to be particularly suitable for this purpose.

As a result of the replacement of Ni with C, N and Mn according to the invention, the content of nickel ("Ni") in the steel according to the invention can be reduced to such an extent that it is "0% by mass" in the technical sense, but in any case less than 0.1% by mass, and is therefore ineffective with respect to the properties of the steel according to the invention, which are the focus here. A potentially allergenic effect is no longer evident in these Ni contents of the steel according to the invention. Thus, if Ni is present at all, it is due to unavoidable impurities that cannot be added to the steel in a targeted manner, but can be introduced into the steel in the course of steel production.

Likewise, the content of cobalt ("Co") in the steel according to the invention is reduced to values of less than 0.1% by mass, at which values Co has no effect on the properties of the steel material according to the invention and no health endangering effect can result from its presence. Accordingly, the Co content according to the invention is likewise preferably reduced to "0% by mass" in the technical sense, but at least to such a low level that it is present at most in the contents attributable to the impurities unavoidable due to the production process.

Chromium ("Cr") is present in the steel according to the invention in contents from 17% by mass to 27% by mass in order to ensure sufficient corrosion resistance. In this content range, Cr forms a dense chromium oxide layer on components made of steel according to the invention, which chromium oxide layer prevents corrosion reactions. The contents of at least 17% by mass ensure that corrosion resistance is also present in the potentially very aggressive environment of the oral cavity. By increasing the Cr content to at least 18% by mass, in particular to at least 19% by mass, the reliability with which the steel material according to the invention withstands corrosive attacks can be further increased. At the top end, the Cr content of a steel according to the invention is limited to not more than 26% by mass in order to avoid the excessive formation of primary carbides that would impair the toughness and ductility of the steel. In addition, contents of more than 26% by mass Cr would stabilize the ferritic phase in the structure of the steel according to the invention, with the result that the non-magnetic properties of the steel material according to the invention would no longer be ensured. The aforementioned negative effects of the presence of Cr in the steel according to the invention can be countered particularly reliably by limiting the Cr content to not more than 25% by mass, in particular to not more than 24% by mass.

For the materials according to the invention, the percentage of impurities is set in accordance with the stipulations prescribed for dental material in DIN EN ISO 22674:2016-09. Thus, the percentage of impurities in particular can be limited to 0.5 mass %. Less than 0.1 mass % Ni and less than 0.1% Co count toward the impurities, for example.

The pitting resistance equivalent number "PREN" expresses the influence of the alloying elements Cr, Mo and N on the corrosion resistance of the steel material according to the invention, wherein the invention calculates the PREN value according to the equation PREN=% Cr+3.3×% Mo+20×% N, where % Cr=respective Cr content, % Mo=respective Mo content and % N=respective N content of the steel. By adjusting the Cr, Mo and N contents of the steel according to the invention in such a way that PREN values of more than 30%, in particular more than 34%, are obtained, an optimized corrosion resistance can be ensured, wherein PREN values of at least 38%, in particular at least 40% or at least 45% prove to be particularly advantageous here.

In the steel material according to the invention, the melting interval, i.e., the temperature range in which the steel is present in a molten state, is shifted to a favorable temperature range. For example, it is typically Tsol=1250° C. to Tliq=1350° C. The melting interval, which is significantly greater than that of conventional steels of the type discussed here and which is already available at lower temperatures, results in improved mold filling during melt processing (casting), while at the same time reducing the stress on the melting installations and molding materials.

The chromium oxide layer formed by Cr on the steel according to the invention can be stabilized by the addition of up to 6% by mass of molybdenum ("Mo"). In particular, an increase in the resistance to pitting corrosion can be achieved by adding Mo. If they are to be used, a Mo content of at least 0.5% by mass, in particular at least 0.6% by mass, can be added to the steel according to the invention. The positive influences of Mo can be used particularly effectively given Mo contents of up to 5.5% by mass, in particular up to 5.0% by mass.

Like Mo, tungsten ("W") can also be added to the steel according to the invention in contents of up to 6% by mass to increase the corrosion resistance. If this effect is to be utilized, a W content of at least 0.5% by mass, in particular of at least 0.6% by mass, can be provided in the steel according to the invention. The favorable effects of the presence of W at W contents of up to 5.5% by mass, in particular up to 5.0% by mass, can be used particularly effectively.

Another challenge addressed by the invention was to adjust the alloy of the steel according to the invention in such a way that the coefficient of thermal expansion CTE from room temperature ("RT") to 400° C. is reduced to a level at which a permanently secure adhesion of a ceramic veneer applied to the steel is ensured. In particular due to their good solubility in Fe, the elements Cr, Mo and W are suitable for reducing the coefficient of thermal expansion CTE. An increase in the contents of Cr, Mo and W alone for this purpose would, however, be accompanied by an increased ferrite-stabilizing effect. This effect was counteracted by a simultaneous increase in the contents of the elements C, N and Mn. As a result, it is thus possible to adjust the coefficient of thermal expansion CTE of a material according to the invention to values that are not more than $24\times10^{-6}$/K, wherein the coefficient of thermal expansion CTE is typically in the range of $15\times10^{-6}$/K to $22\times10^{-6}$/K.

Niobium ("Nb") and/or gallium ("Ga") and/or tantalum ("Ta") may also be added to the steel in contents of up to 6% by mass, optionally as an alternative to or in combination with the Mo- and/or W contents provided for this purpose, likewise to reduce the coefficient of thermal expansion. This effect can be reliably utilized in the case of Nb contents of at least 0.5% by mass and/or Ga contents of at least 0.5% by mass and/or Ta contents of at least 0.5% by mass. Nb, Ta and Ga can be added in each case separately or in combination. However, with sufficient contents of Mo, it is also possible to dispense with the addition of Nb, Ta and/or Ga altogether. Likewise, each of the elements Nb, Ta and Ga can also be added alone in order to achieve the improvements made possible by the presence of these elements in the steel according to the invention. The positive effects of the optional presence of Nb, Ta and/or Ga can be particularly reliably utilized at a content of at least 0.6% by mass of Nb, Ta and/or Ga, wherein contents of at least 0.7% by mass of at least one of the elements Nb, Ta, Ga can be particularly expedient for this purpose.

Optional contents of up to 5.0% by mass, in particular up to 1.0% by mass, of Nb, Ta and/or Ga have proven to be particularly practical.

In the case that more than one element from the group "Nb, Mo, W, Ga, Ta" is present, the effect of these elements can be utilized in particular with the advantages explained above if the contents of these elements in total are 0.5-10.0% by mass, in particular 0.5-6% by mass or 0.5-1% by mass.

The structure of a steel according to the invention is completely austenitic in the technical sense due to the steel alloy specified according to the invention. Steel according to the invention is therefore also definitely non-magnetic. Accordingly, it is characterized by a relative permeability μR determined by means of a permeability meter in accordance with ASTM A342 and EN 60404-15, where: $1.0\leq\mu R\leq1.2$.

The steels according to the invention can be made available for processing in the dental laboratory or for large-scale industrial processing as semi-finished products in the form of cast ingots or cast nuggets, which during further processing are re-melted and formed by casting technology into implants, prostheses or medical instruments and the like, which are intended for use in or on the human or animal body. The particularly good castability of the steels according to the invention is particularly suitable for this manufacturing path.

Likewise, the steels according to the invention can be processed in a manner known per se into steel powders, which are subsequently formed by means of an additive method, also called metallic "3D printing," into implants, prostheses or instruments used in the treatment and examination of humans or animals. Methods that are suitable for this purpose are described in the VDI status report "Additive Fertigungsverfahren," September 2014, published by the Verein Deutscher Ingenieure e.V., Department of Production Engineering and Manufacturing Processes, www.vdi.de/statusadditiv, and in the VDI guidelines 3404 and 3405.

Furthermore, the steel according to the invention can be provided in the form of so-called milling disks, from which implants, prostheses or medical instruments and the like are subsequently produced by machining methods, in particular milling, for example by using known CAD/CAM methods.

Regardless of the respective processing path, the steels according to the invention are particularly suitable for the manufacture of elements used as dental prostheses or required as parts of dental prostheses.

In this case, semi-finished products, implants, prostheses and the like produced from the steels according to the invention can also be subjected in particular to mechanical finishing, which can, of course, follow the respective forming method described above.

The invention is explained in more detail below in reference to a drawing depicting an exemplary embodiment. In which, in each case schematically: In a first series of tests, four steels M1_1 to M1_4 were melted, whose compositions are indicated in Table 1.

In a first series of tests, four steels M2_1 to M2_5 were melted, whose compositions are indicated in Table 2.

All contents of alloying elements not specified in Tables 1 and 2 were in the impurity range and were less than 0.5% by mass in total. The contents of the alloy constituents not listed in Tables 1 and 2 were thus so small that they had no effect on the properties of the steels M1_1 to M1_4 and M2_1 to M2_5.

The melts of the steels M1_1 to M1_4 and M2_1 to M2_5 were cast in each case into ingots, which formed the starting material for further processing. Each of the steel melts solidified completely austenitically in the technical sense.

To evaluate the magnetic properties of the ingot obtained, the relative permeability μR of the ingot consisting of the melts M1_1 to M1_4 was determined. The respectively determined permeabilities μR are likewise listed in Table 1. It was found that all ingots consisting of the steels M1_1 to M1_4 were reliably non-magnetic (μR=1).

The ingots consisting of the steels M2_1 to M2_5 also proved to be completely non-magnetic.

The coefficients of thermal expansion CTE have been determined for the steels M2_1 to M2_5. The CTE values are also listed in Table 2 for the ingots consisting of the steels M2_1 to M2_5.

The strength of the ingot was likewise tested according to DIN EN ISO 22674:2016-09. Here, the ingots consisting of the steels M1_1 to M1_4 and M2_1 to M2_5 in each case reliably fulfill the requirements of Class 3.

In the dental laboratory, the ingots, consisting of the steels M1_1 to M1_4 and M2_1 to M2_5, were re-melted at a melting interval of 1270-1350° C. and cast into molds to form implants. Each of the steels M1_1 to M1_4 and M2_1 to M2_5 showed very good casting behavior. The casting experiments in each case resulted in complete mold filling, even in the case of complex geometries.

Subsequently, the implants obtained during the casting experiments have been provided with a ceramic veneer. The veneering ceramic offered by Wegold Edelmetalle GmbH, 90350 Wendelstein, Germany, under the name "classica•Opaquer Paste•D2•6 g," which is based on a leucite glass ceramic (see the "Classica Verarbeitungsanleitung" published by the manufacturer, imprint QMF 4.5-1277, rev. b of Dec. 12, 2019.)

In each of the implants produced from the steels M1_1 to M1_4 as well as M2_1 to M2_5, the veneering of the implants can be carried out without problems and can be reliably reproduced. There were no cracks or similar defects, even under load.

TABLE 1

| Steel | C + N | C | N | Si | Mn | Cr | Mo | Ni | μ | PREN |
|---|---|---|---|---|---|---|---|---|---|---|
| | [% by mass] *) | | | | | | | | | |
| M1_1 | 1.0 | 0.4 | 0.6 | <0.1 | 21 | 18.0 | 2.0 | <0.1 | 1.0009 | 34.2 |
| M1_2 | 1.35 | 0.34 | 1.01 | <0.2 | 18.1 | 23.3 | 2.0 | <0.1 | 1.0016 | 46.6 |
| M1_3 | 1.32 | 0.34 | 0.97 | 0.2 | 18.1 | 24.3 | 1.95 | <0.1 | 1.0029 | 46.3 |
| M1_4**) | 1.1 | 0.1 | 1.0 | <0.2 | 23.5 | 20.5 | 1.0 | <0.1 | 1.0009 | 39.8 |

*) remainder iron and unavoidable impurities

**)not according to the invention

TABLE 2

| Steel | C + N | C | N | Si | Mn | Cr | Mo | Ni | W | CTE |
|---|---|---|---|---|---|---|---|---|---|---|
| | [% by mass] *) | | | | | | | | | [$10^{-6}$/K] |
| M2_1 | 1.0 | 0.4 | 0.6 | <0.1 | 21 | 18.0 | 2.0 | <0.1 | — | |
| M2_2 | 1.0 | 0.4 | 0.6 | <0.1 | 21 | 18.0 | 2.0 | <0.1 | 1.0 | 17.2 |
| M2_3 | 1.0 | 0.4 | 0.6 | <0.1 | 21 | 18.0 | 2.0 | <0.1 | 2.0 | 16.8 |
| M2_4 | 1.0 | 0.4 | 0.6 | <0.1 | 21 | 18.0 | 2.0 | <0.1 | 3.0 | 16.5 |
| M2_5 | 1.0 | 0.4 | 0.6 | <0.1 | 21 | 18.0 | 2.0 | <0.1 | 4.0 | 16.3 |

*) remainder iron and unavoidable impurities

The invention claimed is:

1. A steel having an austenitic structure, an offset yield strength Rp0.2 of at least 230 MPa, a percent elongation A of more than 5%, and a modulus of elasticity of at least 150 GPa, consisting of, in % by mass,

C: >0.2-0.8%,

N: 0.97-1.3%,

Si: <2.0%,

Mn: 14-30%,

Cr: >20-27%,

Mo: 0-6%,

W: 0-6%,

Nb: 0-6%,

Ga: 0-6%,

Ta: 0-6%, and the remainder being iron and unavoidable impurities, wherein the total content of unavoidable impurities is less than 0.5%, Ni as an impurity is less than 0.1% and Co as an impurity is less than 0.1%, wherein a coefficient of thermal expansion (CTE) of the steel in the temperature range from room temperature to 400° C. is less than or equal to $25\times10^{-6}$/K, wherein the content of at least one element selected from the group consisting of Nb, Mo, W, Ga, and Ta is at least 0.5% by mass, and wherein the sum of the contents of Nb, Mo, W, Ga, and Ta is not more than 10% by mass.

2. The steel according to claim 1, wherein the sum of C and N is less than or equal to 2.0% by mass.

3. The steel according to claim 1, wherein the Mn content is 16-30% by mass.

4. The steel according to claim 1, wherein the Mn content is 14-28% by mass.

5. The steel according to claim 1, wherein, a PREN value, which is calculated according to the following equation:

$$PREN=\%\ Cr+3.3\times\%\ Mo+20\times\%\ N$$

wherein % Cr is the Cr content, % Mo is the Mo content, and % N is the N content, in each case in % by mass, satisfies:

$$25\leq PREN\leq 75.$$

6. The steel according to claim 1, wherein relative permeability (μR) of the steel is $1.0\leq\mu R\leq1.2$.

* * * * *